US006482112B1

(12) United States Patent
Betz

(10) Patent No.: US 6,482,112 B1
(45) Date of Patent: Nov. 19, 2002

(54) RETRACTABLE SPORTS NET

(76) Inventor: Greg E Betz, 7008 Kingsmill Way, Citrus Heights, CA (US) 95610

( * ) Notice: Subject to any disclaimer, the term of this patent is extended or adjusted under 35 U.S.C. 154(b) by 5 days.

(21) Appl. No.: 09/617,413

(22) Filed: Jul. 17, 2000

(51) Int. Cl.[7] ..... A63B 69/00
(52) U.S. Cl. ..... 473/421; 473/435
(58) Field of Search ..... 473/415, 421, 473/434, 435, 422, 439

(56) References Cited

U.S. PATENT DOCUMENTS 4,326,717 A * 4/1982 McClimon ..... 473/197
5,409,230 A * 4/1995 Dunaway et al. ..... 473/161

* cited by examiner

*Primary Examiner*—Paul T. Sewell
*Assistant Examiner*—M. Chambers
(74) *Attorney, Agent, or Firm*—Risto A. Rinne, Jr

(57) ABSTRACT

An apparatus for the practice of any sport involving a ball that is propelled in the air includes a planar section of netting that is surrounded by an elastic cord. The netting is attached to the elastic cord by a plurality of rings that are attached to the netting and which also encircle the elastic cord. A ceiling plate is attached to the ceiling and it includes a locking mechanism that secures a draw cord in any desired position. The draw cord is used to raise or lower a base tray portion of the apparatus from an upper position proximate the ceiling plate to a lower position of rest upon a floor or ground surface. When the base tray portion is raised it gathers the netting as it is raised until it makes contact with a pair of end caps that are attached to the ceiling plate at opposite ends thereof. In the raised position, the apparatus forms a neat closed assembly that contains the netting. The base tray portion includes a pair of planar end members that are each attached to a center planar member by hinges. The pair of end members are, therefore, adapted to rest flat upon the ground when lowered and to elevate at an angle with respect to the ground when raised. When the end members are flat upon the ground the netting is unfurled and the apparatus is adapted for use to attenuate the kinetic energy of the ball.

24 Claims, 3 Drawing Sheets

RETRACTABLE SPORTS NET

BACKGROUND OF THE INVENTION

1. Field of the Invention

The present invention, in general, relates to nets and, more particularly, to devices that can safely attenuate the kinetic energy of a ball.

There are numerous occasions in a variety of sports when a ball is impelled with either great force or velocity. Some examples include baseball, tennis, and golf, just to name a few. There are countless other sports that rely upon a ball of some sort that is either thrown or struck.

Many enthusiasts of these types of sports would like to be able to practice their preferred sport at home. However space is a problem. A net that can catch a ball and attenuate its energy is desirable, but a convenient type of a net has not heretofore been available.

An ideal net must be easy to set up and to remove from use. It should not utilize valuable floor space when it is not in use. Furthermore, it should not present abrupt or hard surfaces that a ball can impact upon. Such a surface would pose a hazard to the user in that the ball could ricochet back and strike the user or the device, itself, could be damaged.

Accordingly there exists today a need for a retractable sports net that is easy to set up and remove, does not take up floor space when not in use, and lessens the likelihood of damage to the device occurring from a ball impact or of a ricochet occurring.

Clearly, such an apparatus would be a useful and desirable device.

2. Description of Prior Art

Nets and the like are, in general, known. For example, the following patents describe various types of these devices:

U.S. Pat. No. 3,227,449 to Schwab, Jan. 4, 1966;

U.S. Pat. No. 4,153,246 to Byrne, May 8, 1979;

U.S. Pat. No. 4,183,524 to Kifferstein et al., Jan. 15, 1980;

U.S. Pat. No. 4,643,423 to Wright, Feb. 17, 1987;

U.S. Pat. No. 5,007,645 to Weigl et al., Apr. 16, 1991;

U.S. Pat. No. 5,205,564 to Lamberti et al., Apr. 27, 1993;

U.S. Pat. No. 5,409,230 to Dunaway et al., Apr. 25, 1995;

U.S. Pat. No. 5,571,266 to Nichols, Nov. 5, 1996;

U.S. Pat. No. 5,722,905 to Bidelman, Mar. 3, 1998; and

U.S. Pat. No. 5,947,831 to McCarthy, Sep. 7, 1999.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a retractable sports net that is easy to use.

It is also an important object of the invention to provide a retractable sports net that is suspended from a ceiling.

Another object of the invention is to provide a retractable sports net that retracts off of a floor when not in use.

Still another object of the invention is to provide a retractable sports net that attenuates the energy of an object (i.e. a ball) that strikes it.

Still yet another object of the invention is to provide a retractable sports net that decreases the chances of a ricochet occurring.

Yet another important object of the invention is to provide a retractable sports net that is attractive.

Still yet another important object of the invention is to provide a retractable sports net that is inexpensive to manufacture.

Still yet one other important object of the invention is to provide a retractable sports net that can be adapted for use with different sizes and types of balls.

Briefly, a retractable sports net that is constructed in accordance with the principles of the present invention has a ceiling mounting plate that is attached overhead to a ceiling. A base tray portion includes a pair of oppositely disposed planar end members that are hinged to a center planar member. A section of fabric netting is disposed intermediate the ceiling mounting plate and the center planar member. The pair of end members and the center planar member can be hoisted into a raised position proximate the ceiling mounting plate and lowered into a lower position that is adapted for use where they contact a floor under the ceiling mounting plate by the use of a lift cord and locking mechanism. When the pair of end members and the center member are lowered, the fabric netting is unfurled so as to present a vertical planar structure that is adapted to receive a ball. An elastic cord extends along the perimeter of the netting and helps to attenuate the energy of the ball. An optional weight pocket helps to lower the netting and optional stiffening ribs add strength to the end members.

DETAILED DESCRIPTION OF THE INVENTION

Figure 1:
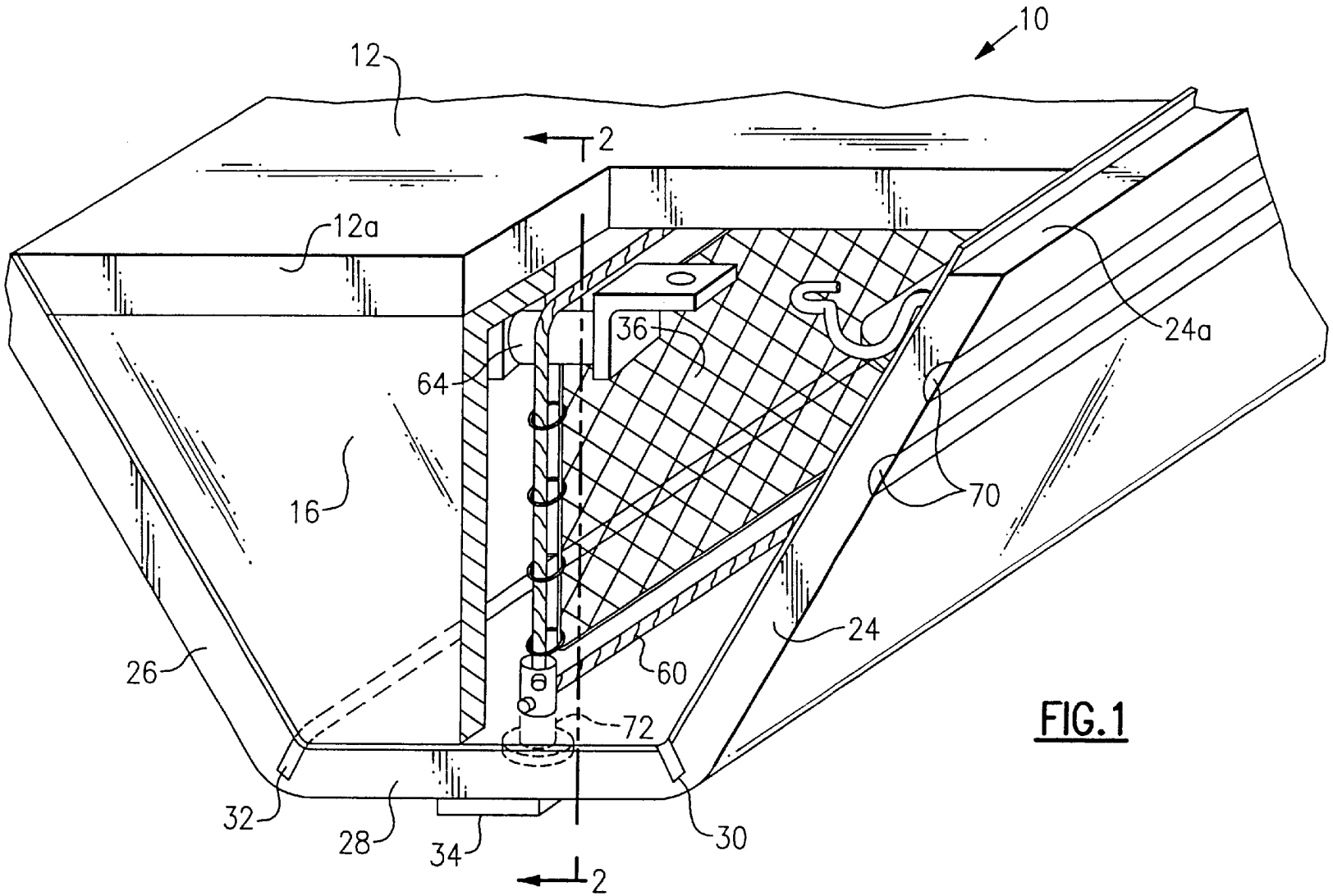
FIG. 1 is a view in perspective of a portion of a retractable sports net.

Referring, on occasion to all of the drawings and in particular to FIG. 1 is shown, a retractable sports net, identified, in general, by the reference numeral 10.

A ceiling mounting plate 12 is attached to the ceiling 14 (FIG. 2) by screws (not shown) or by any other preferred method. The retractable sports net 10 may be mounted wherever desired such as at an opening proximate a garage door (not shown), in a garage (not shown), a family room (not shown), a fitness center (not shown), or any other type of a structure with an overhead ceiling.

Figure 2:
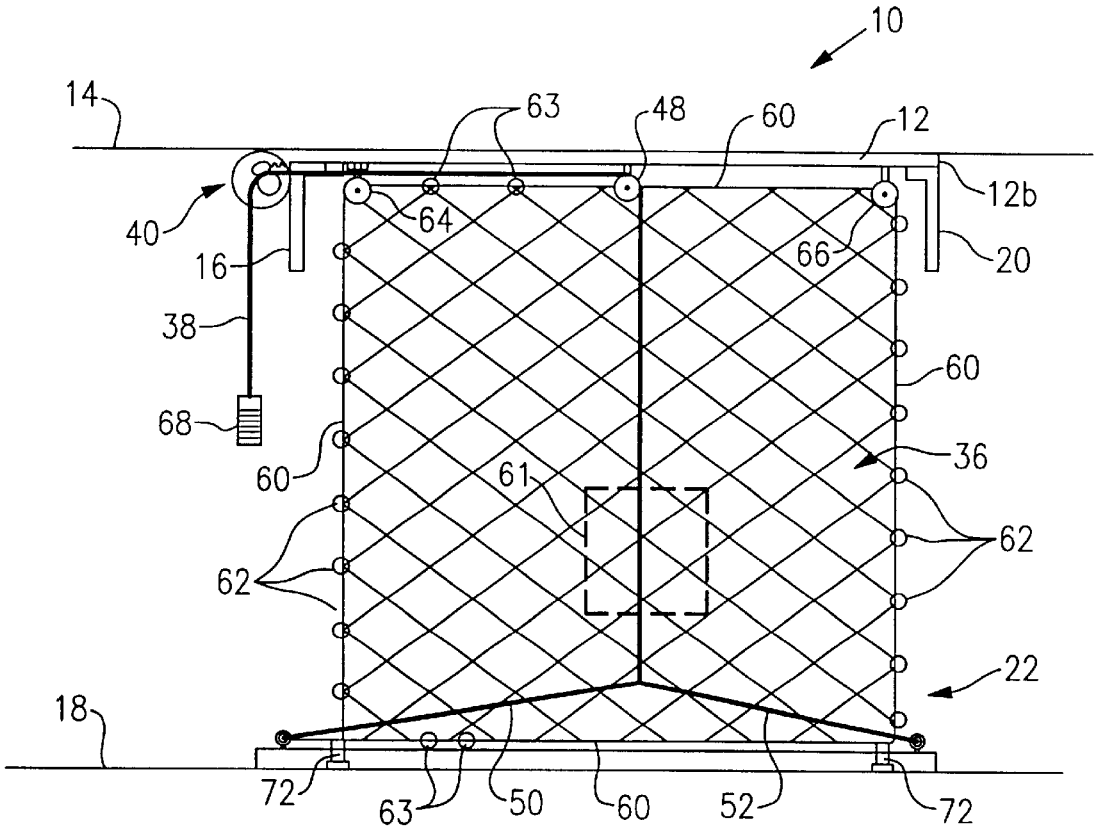
FIG. 2 is a cross sectional view taken on the line 2—2 in FIG. 1 except that an assembly portion is shown in a raised position in FIG. 1 and in a lower position in FIG. 2.

A first end cap 16 is attached to the ceiling mounting plate 12 at a first end 12*a* and extends perpendicularly therefrom in a vertical orientation with respect to a floor 18 (FIG. 2). A second end cap 20 is similarly attached to the ceiling mounting plate 12 at a second end 12*b* that is opposite the first end 12*a*.

The first and second end caps 16, 20 have, in the vertical orientation, a substantially trapezoidal shape that is adapted to receive other component parts of the retractable sports net 10 in a manner, as is described in greater detail hereinafter.

The retractable sports net 10 includes an assembly (identified, in general, by the reference numeral 22, FIG. 2) that can be lifted into a first raised position (as shown in FIG. 1) that is proximate the ceiling mounting plate 12 or it can be released into a second lower position (as shown in FIG. 2) that extends away from the ceiling mounting plate 12 and end caps 16, 20. In the lower position the assembly 22 rests substantially upon the floor 18.

The assembly 22 includes a base tray portion that includes a pair of oppositely disposed planar end members 24, 26 that are hingedly attached to a center planar member 28 by a first hinge 30 and a second hinge 32, respectively. The hinges 30, 32 are either formed integral with the base tray portion or are added thereto, as desired.

An optional weight pocket 34 may be attached where desired to the base tray portion and be used to provide extra weight that is useful to help extend the assembly 22 into the second lower position. The weight pocket 34 contains any mass that is desired, and may be filled at the site, for example, with sand (not shown).

The hinges 30, 32 are important in that when the assembly 22 is in the second lower position they permit the end members 24, 26 to extend and lay flat upon the floor 18. This provides a minimum impact surface (24*a* FIG. 1) that is limited to the thickness of the first end member 24. Only the impact surface 24*a* of the first end member 24 is exposed to a user (not shown) of the retractable sports net 10.

It is also noted that in the second lower position, the impact surface 24*a* that is exposed is at an angle and that angle would only serve to deflect the ball upward and into a netting 36 (FIG. 2) should the ball happen to strike the impact surface 24*a* portion of the first end member 24. Therefore, there is virtually no chance of a ricochet of the ball back to the user occurring, thereby increasing safety.

It is also most unlikely that a ball will be traveling so close to the floor 18 that it is able to strike the impact surface 24*a*. For most applications, during use the ball will make contact with the netting 36 near its center and not near the floor 18. However, if the ball is impelled close to the floor 18 the present design affords protection to both the retractable sports net 10 as well as to the user.

The netting 36 is preferably of any desired fabric and weave as desired. Obviously, a denser material for use as the netting 36 is required to stop a golf ball (not shown) than would be minimally required to stop a tennis ball (not shown) or a baseball/softball (not shown).

The choice of material for the netting 36 is selected as desired for the application intended. Of course, if desired, a fine weave for the netting 36 may be universally used to satisfy a wide variety of applications for the retractable sports net 10. How the netting 36 is attached to the retractable sports net 10 is described in greater detail hereinafter.

There are any number of methods possible to raise or lower the retractable sports net 10 and the method described is intended to suggest only one such way. A lift cord 38 and a locking mechanism 40 (shown in greater detail in FIG. 3) are used to raise or lower the assembly 22 and the netting 36.

The lift cord 38 passes through an opening in the first end cap 16 (not shown in the FIG. 1 drawing). The locking mechanism 40 may be attached to the ceiling or to the retractable sports net 10, as desired (see FIG. 3). The locking mechanism 40 includes a torsion spring 42 that pulls a pivoting cam 44 into contact with a first pulley 46.

Figure 3:
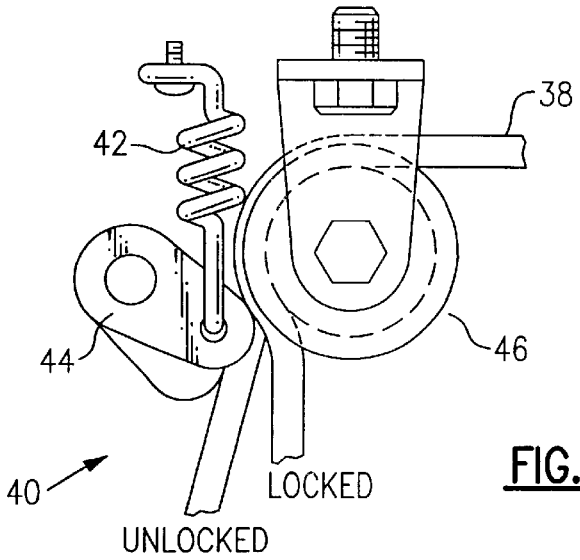
FIG. 3 is an enlarged view of the locking mechanism of FIG. 2.

If the lift cord 38 is released, the torsion spring 42 pulls (i.e., pivots) the cam 44 toward the first pulley 46 and secures the lift cord 38 in place, normally in the first raised position, by pinching the cam 44 against the lift cord 38 and the first pulley 46. This prevents the first pulley from rotating in a clockwise direction (as shown in FIG. 3).

If tension is applied by the user to the lift cord 38, the cam 44 is held away from the first pulley 46 and the lift cord 38 can be lowered so that the assembly 22 extends down into the second lowered position.

An idler pulley 48 is centrally disposed on the ceiling mounting plate 12. The lift cord 38 branches out into four segments (a first segment 50 and a second segment 52 are shown) that attach to each of four outermost corners of the two end members 24, 26.

When the lift cord 38 is pulled, the four segments 50, 52 lift the end members 24, 26 into a somewhat vertical orientation thereby providing a "container" that is able to neatly gather the netting 36 as the base tray portion (i.e., the assembly 22) is hoisted up.

As the end members 24, 26 are more fully raised, they contact the end caps 16, 20 and are extended, as necessary, outward so as to bear against them when fully hoisted.

In the first raised position, the base tray portion (i.e., 24, 26, 28) and the end caps 16, 20 of the retractable sports net 10 cooperate to form a closed structure that hides the netting 36 and internal components from view, thereby making the retractable sports net 10 neat and attractive in appearance.

An elastic cord 60 surrounds the netting 36 and is in a somewhat extended position in the second lowered position. The netting 36 includes a plurality of rings 62 on two sides thereof that attach the netting 36 to the elastic cord 60 in such a way that that the netting 36 can be gathered when hoisted and fully extended when lowered because the rings 62 are able to slide along the longitudinal length of the elastic cord 60.

The elastic cord 60 provides a perimeter support structure that keeps the netting 36 in an open substantially rectangular planar shape and it also "gives" (i.e., it extends or stretches) during impact of the ball so as to help the netting 36 better attenuate the kinetic energy of the ball.

The ball is typically struck or otherwise is thrown by the user so as to impact the netting 36. For example, a baseball pitcher (not shown) may be one user of the retractable sports net 10. The retractable sports net 10 may include the imprint or outline of a target area 61 on the netting 36. The target area 61 may be used as a reference to aim for with the retractable sports net 10 when the pitcher practices throwing the ball, in this case a baseball, at the target area 61 of the netting 36.

Additional rings 63 may be used, if desired, at the top and bottom of the netting 36. All of the rings 62, 63 permit movement of the netting 36 with respect to the elastic cord 60. This further helps to attenuate the kinetic energy caused by impact of the ball with the netting 36.

A second pulley 64 and a third pulley 66 are attached to the ceiling mounting plate 12 and provide a support for the elastic cord 60, and accordingly, for the top of the netting 36. The second and third pulleys 64, 66 may include brackets that are useful to secure the ceiling mounting plate 12 to the ceiling 14, as desired.

The elastic cord 60 is able to stretch when the assembly 22 is lowered and to contract around the second and third pulleys 64, 66 when the assembly 22 is hoisted. If desired, a take-up reel (not shown) can be used to wind the elastic cord 60 when the assembly 22 is hoisted and to dispense the elastic cord 60 when the assembly 22 is lowered.

A pair of pins 72 are attached to the center planar member 28 on opposite ends and are used to secure the elastic cord 60 (and therefore also the netting 36) to the assembly 22.

If desired, a handle 68 can be attached to the end of the lift cord 38. Similarly, stiffening ribs 70 can be added to the end members 24, 26 as desired.

Figure 4:
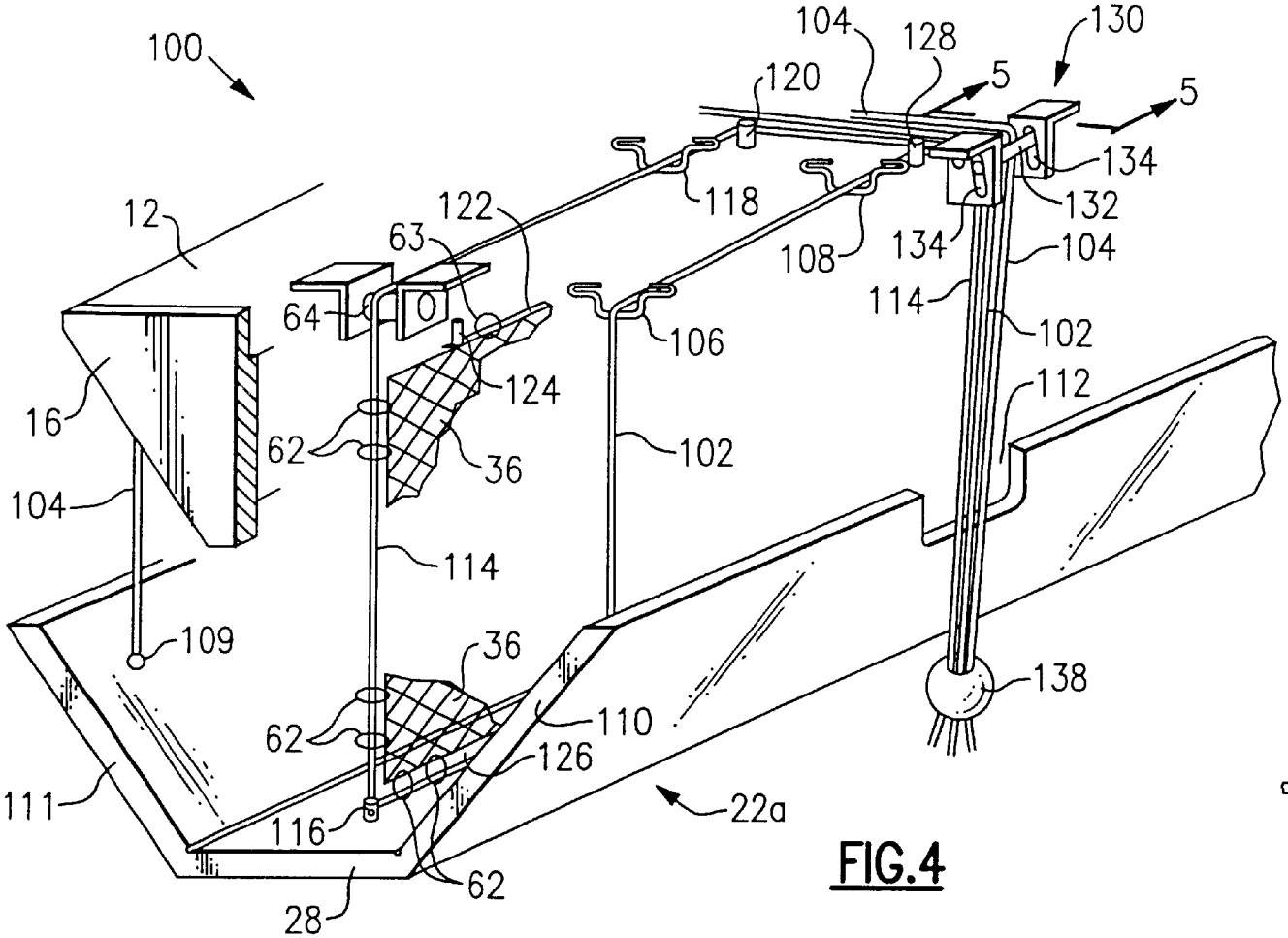
FIG. 4 is a view in perspective of a portion of a modified retractable sports net.

Referring now in particular to FIG. 4 is shown, a modified retractable sports net, identified, in general, by the reference numeral 100. The modified retractable sports net 100 is similar to the retractable sports net 10, and therefore to aid in understanding, nearly identical component parts are identified by the same reference numerals.

The modified retractable sports net 100 utilizes a plurality of two lift cords 102, 104 per side. Only the near side is shown in the drawing view. The far side (not shown) is, essentially, a mirror image and therefore contains a third and a fourth lift cord (not shown).

The first (102) of the two lift cords 102, 104 is supported by a first guide channel 106 and by a second guide channel 108. The first and second guide channels 106, 108 are each attached to the ceiling mounting plate 12.

The second 104 of the two lift cords 102, 104 is similarly supported by its own set of guide channels (not shown).

The first guide channel 106 is disposed directly above where a first end of the first of the two lift cords 102 is attached to a modified planar end member 110 of the base tray portion. The second of the two lift cords 104 similarly terminates and is attached to a pin 109 on a second modified planar end member 111.

The modified planar end member 110 includes a center open area 112 through which the two lift cords 102, 104 on the near side and the third and fourth lift cords (not shown) of the far side pass.

A first guide cord 114 is provided on the near side and is attached at a first end thereof to the center planar member 28 at a first mounting location 116.

The first guide cord 114 rises vertically and passes over the third pulley 64 (on the near side). The guide cord 114 then passes through a third guide channel 118 and around a first vertical pin 120, the first vertical pin 120 also being attached to the ceiling mounting plate 12.

The first guide cord 114 is preferably constructed of the same diameter material as the first and second lift cords 102, 104 and may be formed of the same material. The first guide cord 114 aids in lifting the center planar member 28 and therefore the base tray portion as does the first and second lift cords 102, 104.

The first guide cord 114 serves primarily to align the sides of the net 36 and maintain them in a proper spaced apart vertical orientation when the modified retractable sports net 100 is in use (i.e., when it is in the down position) and to aid in collecting the net 36 as it the base tray portion is raised.

The first guide cord 114 may include an elastic material to help in attenuating kinetic energy of the ball when striking the net 36, although this is not required.

A second guide cord (not shown) is used on the far side and is essentially a mirror of the first guide cord 114 in all ways. The rings 62 secure the net 36 to the first and second guide cords 114 on both vertical sides of the net 36.

A first elastic horizontal strip 122 is attached to the ceiling mounting plate 12 at each end by ceiling pins 124 (only one is shown) and to the top of the net 36 across its width by the use of additional rings 63.

A second elastic horizontal strip 126 is attached at a first end to the center planar member 28 at the first mounting location 116 and to a second mounting location (not shown) on the opposite end of the center planar member 28. Additional rings 63 secure the net 36 to the second elastic horizontal strip 126 across the bottom width of the net 36.

A second vertical pin 128 is attached to the ceiling mounting plate 12 and is used to redirect the direction of the first lift cord 102 in much the same way the first vertical pin 120 redirects the direction taken by the first guide cord 114.

Figure 5:
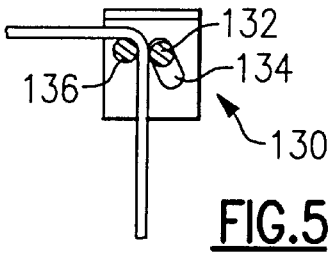
FIG. 5 is a cross sectional view taken on the line 5—5 in FIG. 4 showing a modified latch mechanism to secure the lift cords.

A third vertical pin (not shown) similarly redirects the second drop cord 104 so that it passes through a modified locking mechanism, identified in general by the reference numeral 130. Refer to FIG. 5 as well.

The modified locking mechanism 130 is used to secure the base tray portion in the raised position. A knurled pin 132 rides in a serrated channel 134 on each side of the modified locking mechanism 130. A stationary pin 136 is provided over which the first and second lift cords 102, 104, the third and fourth lift cords (not shown), the first guide cord 114, and the second guide cord (not shown) pass.

The first through the fourth lift cords 102, 104 and the first and second guide cords 114 are disposed intermediate the stationary pin 136 and the knurled pin 132 and pass down through the center open area 112 and to a modified handle 138 that secures all of their ends.

When the modified handle 138 is pulled at an angle away from the modified retractable sports net 100, it draws (i.e., pulls) on all of the cords 102, 104, 114 (and their complements on the far side) and therefore also pulls the knurled pin 132 away from the stationary pin 136 and down in the serrated channel 134.

If the modified handle 138 is then directed toward the modified retractable sports net 100, the knurled pin 132 will remain down in the serrated channel 134 and will permit all of the cords 102, 104, 114 to pass through the modified locking mechanism 130 and therefore the lowering of the base tray portion, identified in general in the FIG. 4 drawing as a modified assembly 22*a* down into a position of use.

If the modified handle 138 is then pulled down, the modified assembly 22*a* is raised into the upper position for storage. To secure the modified assembly 22*a* in the upper position, the modified handle 138 is then pulled slightly away from the modified retractable sports net 100 so that it contacts the knurled pin 132 and is released while being held in that position.

This causes the knurled pin 132 to rise in the serrated channel 134 until it pinches all of the cords 102, 104, 114 against the stationary pin 136. When the modified handle 138 is then released, friction draws the knurled pin 132 even closer to the stationary pin 136 as the cords 102, 104, 114 attempt to drop, further tightening them against the stationary pin 136, therefore securing the modified assembly 22*a* in the raised position.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A retractable sports net, comprising:

(a) a ceiling assembly that is attached to a ceiling;

(b) a second assembly that is adapted to be urged from a first position proximate the ceiling assembly into a second position that is disposed away from the ceiling assembly and wherein said second assembly includes a pair of substantially planar end members and a center planar member intermediate said pair of end members and wherein each of said pair of end members is pivotally attached to said center planar member on one-side thereof;

(c) a netting that forms a flexible planar structure intermediate said ceiling assembly and said second assembly when said second assembly is disposed in said second position; and (d) means for urging said second assembly intermediate said first position and said second position.

2. The retractable sports net of claim 1, wherein said ceiling assembly includes a ceiling mounting plate that is attached to a ceiling.

3. The retractable sports net of claim 2, including a pair of end caps that are attached to said ceiling mounting plate at opposite ends thereof and wherein said pair of end caps extend in a substantially vertical direction away from said ceiling mounting plate a predetermined distance toward said surface.

4. The retractable sports net of claim 3, wherein each of said pair of end caps includes a vertical portion that includes a planar structure that is substantially trapezoidal in shape.

5. The retractable sports net of claim 1 wherein said second assembly includes means for attaching said netting thereto.

6. The retractable sports net of claim 1 including hinge means for attaching each of said pair of end members to said center planar member.

7. The retractable sports net of claim 6 wherein said hinge means is formed integral with said pair of end members and said center planar member.

8. The retractable sports net of claim 6 wherein said hinge means is attached to one of said pair of end members and to said one side of said center planar member.

9. The retractable sports net of claim 1 wherein said netting includes a fabric.

10. The retractable sports net of claim 1 wherein said means for urging includes a drop cord that is attached to said second assembly at one end thereof and is cooperatively engaged with means for guiding said drop cord, said means for guiding being attached to said ceiling assembly, and wherein said drop cord includes a second end that is accessible to a user disposed on said surface.

11. The retractable sports net of claim 10 wherein said means for guiding includes at least one pulley.

12. The retractable sports net of claim 1 wherein said means for urging is adapted to permit a portion of said second assembly to rest in parallel planar orientation with respect to said surface in said second position and wherein said portion of said second assembly is adapted to be displaced into a position that is not in parallel planar orientation with respect to said surface when said second assembly is not disposed in said second position.

13. The retractable sports net of claim 1 wherein said means for urging includes means for retaining said second assembly in said first position.

14. The retractable sports net of claim 13 wherein said means for urging includes at least one cord wherein said at least one cord is adapted to urge said second assembly intermediate said first position and said second position.

15. The retractable sports net of claim 13 wherein said means for retaining includes locking means, said locking means adapted to permit said at least one cord to move relative to said locking means when said locking means is in a first position and adapted to prevent said at least one cord from moving relative to said locking means when said locking means is in a second position.

16. The retractable sports net of claim 15 wherein said locking means is disposed inside said retractable sports net when said second assembly is disposed in said first position.

17. The retractable sports net of claim 15 wherein said locking means is disposed on an external surface of said retractable sports net when said second assembly is disposed in said first position.

18. The retractable sports net of claim 1 wherein said means for urging said second assembly intermediate said first position and said second position includes a plurality of cords, each of said plurality of cords being attached to said second assembly.

19. The retractable sports net of claim 18 including means for guiding said plurality of cords, said means for guiding attached to said ceiling assembly.

20. The retractable sports net of claim 19 including an opening in said second assembly through which said plurality of cords passes.

21. The retractable sports net of claim 1 including elastic means, said elastic means attached to said netting and adapted to attenuate kinetic energy of an object striking said netting.

22. The retractable sports net of claim 21 wherein said elastic means includes an upper elastic member and a lower elastic member, wherein said upper elastic member is attached to said ceiling assembly and said lower elastic member is attached to said second assembly.

23. A retractable sports net, comprising:

(a) a ceiling assembly that is attached to a ceiling;

(b) a second assembly that is adapted to be urged from a first position proximate the ceiling assembly into a second position that is disposed away from the ceiling assembly;

(c) a netting that forms a flexible planar structure intermediate said ceiling assembly and said second assembly when said second assembly is disposed in said second position; and (d) means for urging said second assembly intermediate said first position and said second position wherein said means for urging includes a drop cord that is attached to said second assembly at one end thereof and is cooperatively engaged with means for guiding said drop cord, said means for guiding being attached to said ceiling assembly, and wherein said drop cord includes a second end that is accessible to a user disposed on said surface.

24. A retractable sports net, comprising:

(a) a ceiling assembly that is attached to a ceiling wherein said ceiling assembly includes a ceiling mounting plate that is attached to a ceiling and including a pair of end caps that are attached to said ceiling mounting plate at opposite ends thereof and wherein said pair of end caps extend in a substantially vertical direction away from said ceiling mounting plate a predetermined distance toward said surface and wherein each of said pair of end caps includes a vertical portion that includes a planar structure that is substantially trapezoidal in shape;

(b) a second assembly that is adapted to be urged from a first position proximate the ceiling assembly into a second position that is disposed away from the ceiling assembly;

(c) a netting that forms a flexible planar structure intermediate said ceiling assembly and said second assembly wren said second assembly is disposed in said second position; and (d) means for urging said second assembly intermediate said first position and said second position.

* * * * *